US007222742B2

(12) United States Patent
Liao

(10) Patent No.: US 7,222,742 B2
(45) Date of Patent: May 29, 2007

(54) CAP STRUCTURE FOR A RADIATOR USED IN VEHICLE

(76) Inventor: Wan-Yi Liao, P.O. Box 82-144, Taipei (TW)

( * ) Notice: Subject to any disclaimer, the term of this patent is extended or adjusted under 35 U.S.C. 154(b) by 225 days.

(21) Appl. No.: 10/945,959

(22) Filed: Sep. 22, 2004

(65) Prior Publication Data

US 2006/0060585 A1 Mar. 23, 2006

(51) Int. Cl.
*B65D 51/16* (2006.01)
*G01M 3/04* (2006.01)

(52) U.S. Cl. ..... 220/367.1; 220/303; 220/295; 220/DIG. 32; 73/45.8; 73/49.7

(58) Field of Classification Search ..... 220/295, 220/303, DIG. 32; 73/45.8, 49.7
See application file for complete search history.

(56) References Cited

U.S. PATENT DOCUMENTS 2,760,367 A * 8/1956 Stromberg ..... 73/40
2,847,851 A * 8/1958 Enell ..... 73/40
3,035,436 A * 5/1962 Johnson ..... 73/40
3,313,144 A * 4/1967 Johnson ..... 73/49.7
4,634,017 A * 1/1987 Kilayko ..... 220/203.23
4,667,507 A * 5/1987 Eriksson ..... 73/49.7
4,679,424 A * 7/1987 Tubman ..... 73/45.8
4,809,542 A * 3/1989 Jones ..... 73/45.8
5,069,062 A * 12/1991 Malecek et al. ..... 73/49.7
2003/0189051 A1* 10/2003 Liu ..... 220/303

* cited by examiner

*Primary Examiner*—Anthony D. Stashick
*Assistant Examiner*—James Smalley
(74) *Attorney, Agent, or Firm*—Leong C. Lei

(57) ABSTRACT

A cap structure for a radiator used in vehicle is disclosed. The cap includes a main cap body, a connector shaft, and a leak-seal seat. The main cap body includes a metallic cap body and a heat-isolation covering body joined together using screw as a body. The connector shaft is screwed onto the leak-seal seat, and the connector shaft passes through the through hole of a metallic sleeve mounted on the heat-isolation covering body. The side of the protruded rim of the connector shaft urges the end face of the sleeve and a spring is used to mount the connector shaft onto the main cap body. The heat-isolation covering body with a thickness is mounted onto the metallic cap body and two screws are used to lock the metallic cap body onto the heat-isolation covering body to form a unit, and the end side of the covering body is provided with slip-proof teeth and the metallic sleeve is mounted onto the center circular hole.

1 Claim, 6 Drawing Sheets

CAP STRUCTURE FOR A RADIATOR USED IN VEHICLE

BACKGROUND OF THE INVENTION (a) Technical Field of the Invention

The present invention relates to cap structure, and in particular, to a cap structure for inspection of water pressure leakage within the radiator of a vehicle.

(b) Brief Description of the Prior Art

Taiwanese Utility Model application no. 90217830 entitled "Water Pressure Leakage Inspection Cap Structure" (shown in FIG. 1) discloses a cap structure having a mounting block to increase the contact surface of the screw shaft and a sealing cap, the leakage proof member at the bottom of the screw shaft is effectively mounted to seal the mouth of the radiator to allow accuracy of inspecting water pressure thereof. The drawback of this conventional cap is that while turning the cap, the upper end of the sealing cover is too long, and therefore the exertion of a force is difficult. Further, the surface of the cap is too thin, this makes gripping thereof a problem. The addition of a mounting block causes fabrication process laborious. Accordingly, it is an object of the present invention to provide a cap structure for a radiator used in vehicle which mitigates the drawbacks mentioned above.

SUMMARY OF THE INVENTION

Accordingly, it is an object of the present invention to provide a cap structure for a radiator used in vehicle comprising a main cap body, a connector shaft, and a leak-seal seat, wherein the main cap includes a metallic cap body and a heat-isolation covering body joined together with screw as a body, and the connector shaft is screwed onto the leak-seal seat, and passes through the through hole of a metallic sleeve mounted on the heat-isolation covering body, and the side of the protruded rim of the connector shaft urges the end face of the sleeve and a spring is used to mount the connector shaft onto the main cap body, characterized in that the heat-isolation covering body with a thickness and with heat-isolation property is mounted onto the metallic cap body and two screws are used to lock the metallic cap body onto the heat-isolation covering body to form an unit, and the end side of the covering body is provided with slip-proof teeth and the metallic sleeve is mounted onto the center circular hole, whereby, the mounting of the metallic cap body with the heat-isolation covering body is enhanced by the metallic sleeve mounted with the connector shaft to the leak-seal seat.

Yet still another object of the present invention is to provide a cap structure for a radiator used in vehicle, wherein the cap body is provided with a gripping face with a larger "hand-gripping surface" facilitating holding by the user.

Yet a further object of the present invention is to provide a cap structure for a radiator used in vehicle, wherein the heat-isolation covering body is installed at the recess at the bottom of the metallic cap body, and the connector shaft at the center of the cap body will not bias and the bottom end of the leak-seal seat seals the mouth of the radiator.

Still another object of the present invention is to provide a cap structure for a radiator used in vehicle, wherein the top end of the connector shaft will not urge the palm of the hand of the user.

Still a further object of the present invention is to provide a cap structure for a radiator used in vehicle, wherein the larger and thicker surface provides better grip so that there will not slip when the cap is rotated.

A further object of the present invention is to provide a cap structure for a radiator used in vehicle, wherein the end face of the metallic cap is covered with a heat-isolation covering body having slip-proof property, the covering body is directly formed with the metallic cap body.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
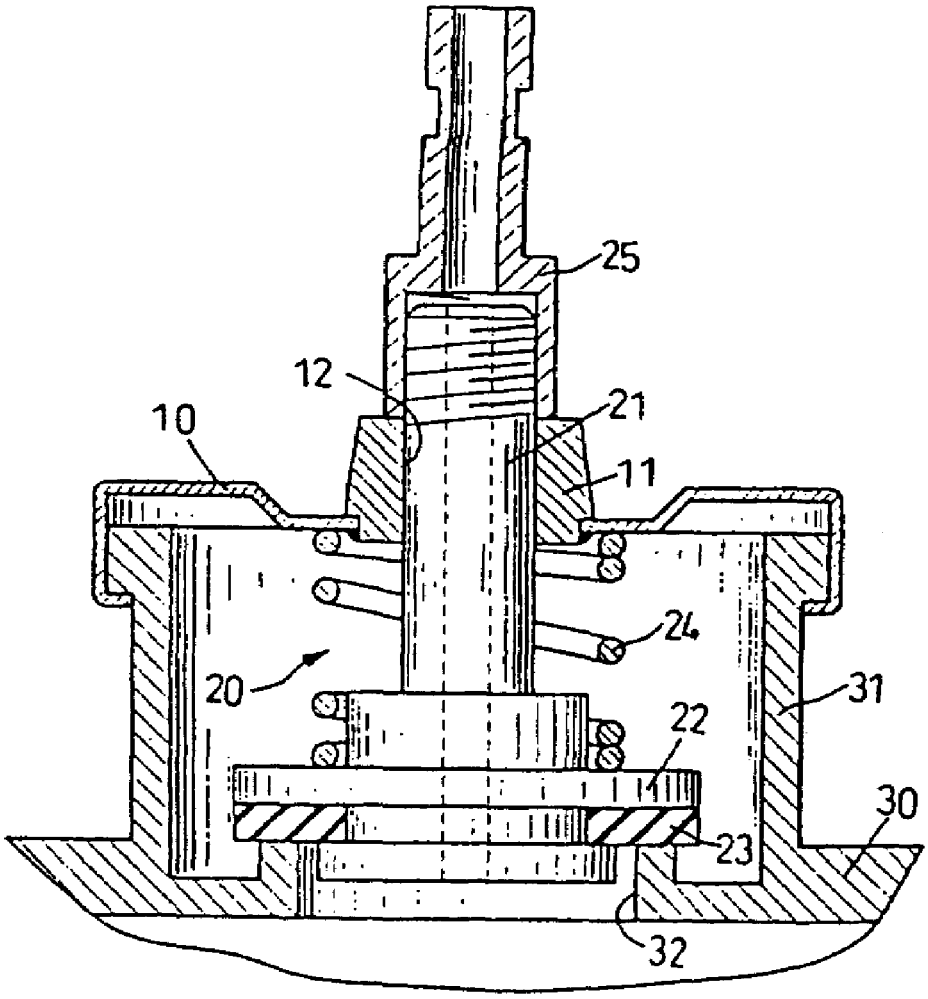
PRIOR ART FIG. 1
FIG. 1 shows conventional cap structure of FIG. 3 of Taiwan Utility Model Publication No. 489755.
Figure 2:
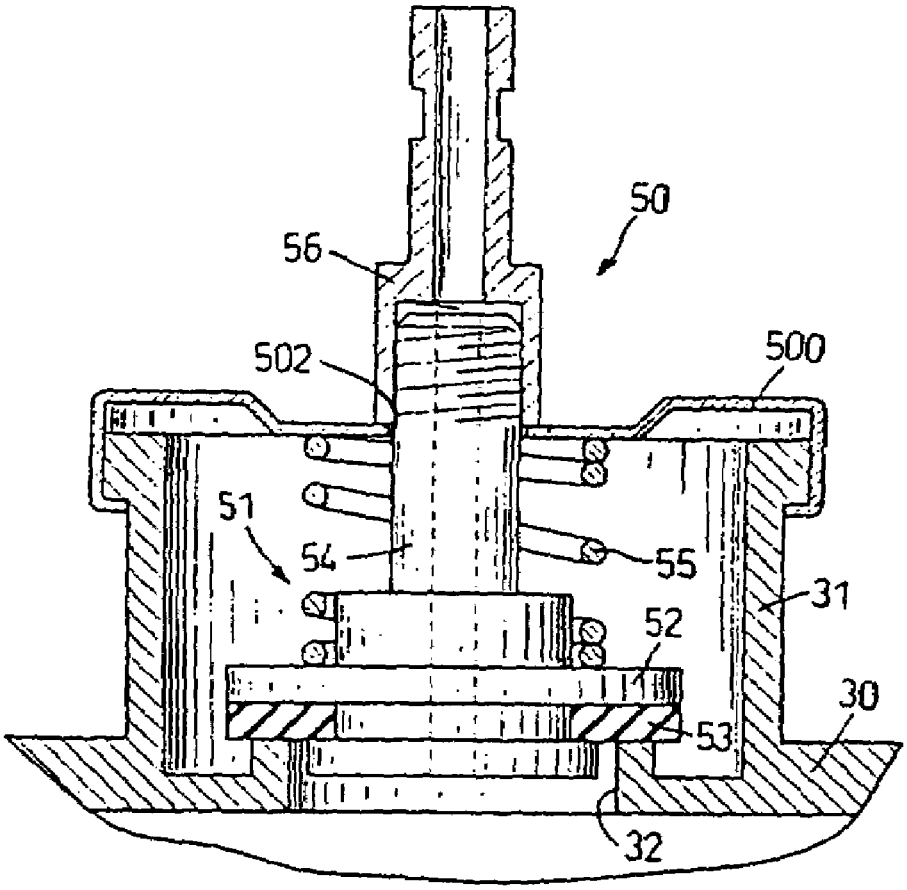
PRIOR ART FIG. 2
FIG. 2 shows conventional cap structure of FIG. 5 of Taiwan Utility Model Publication No. 489755.
Figure 3:
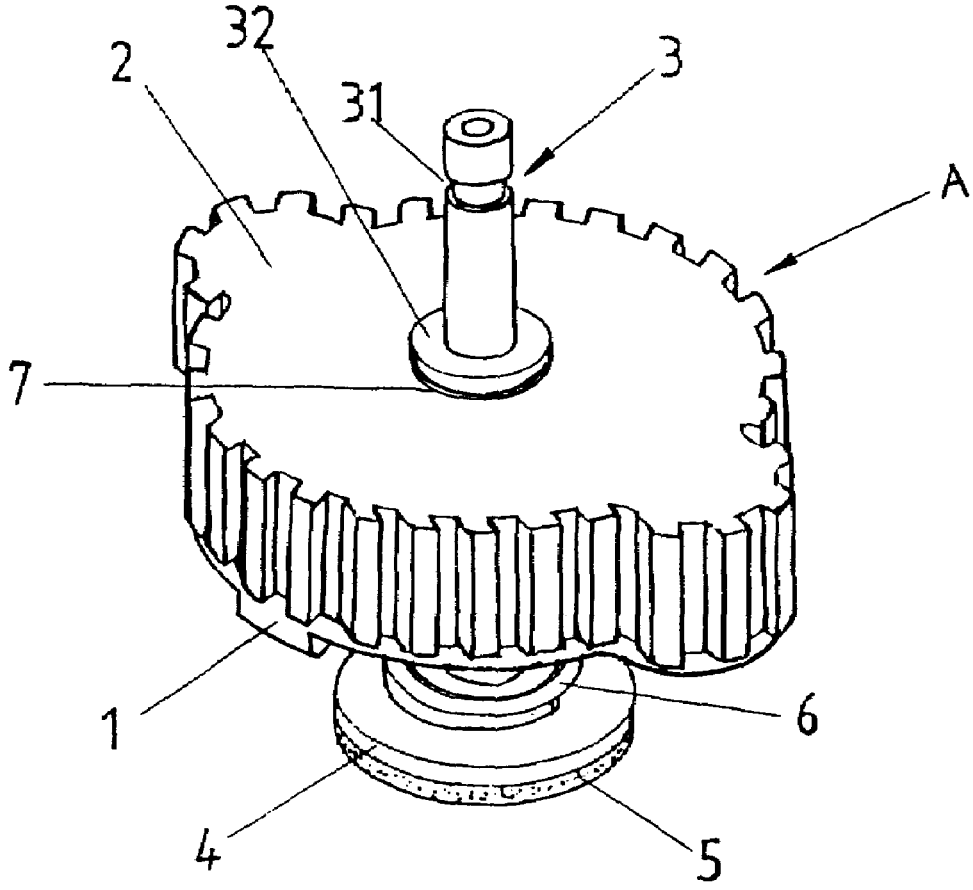
FIG. 3 is a perspective view of the present invention.
Figure 4:
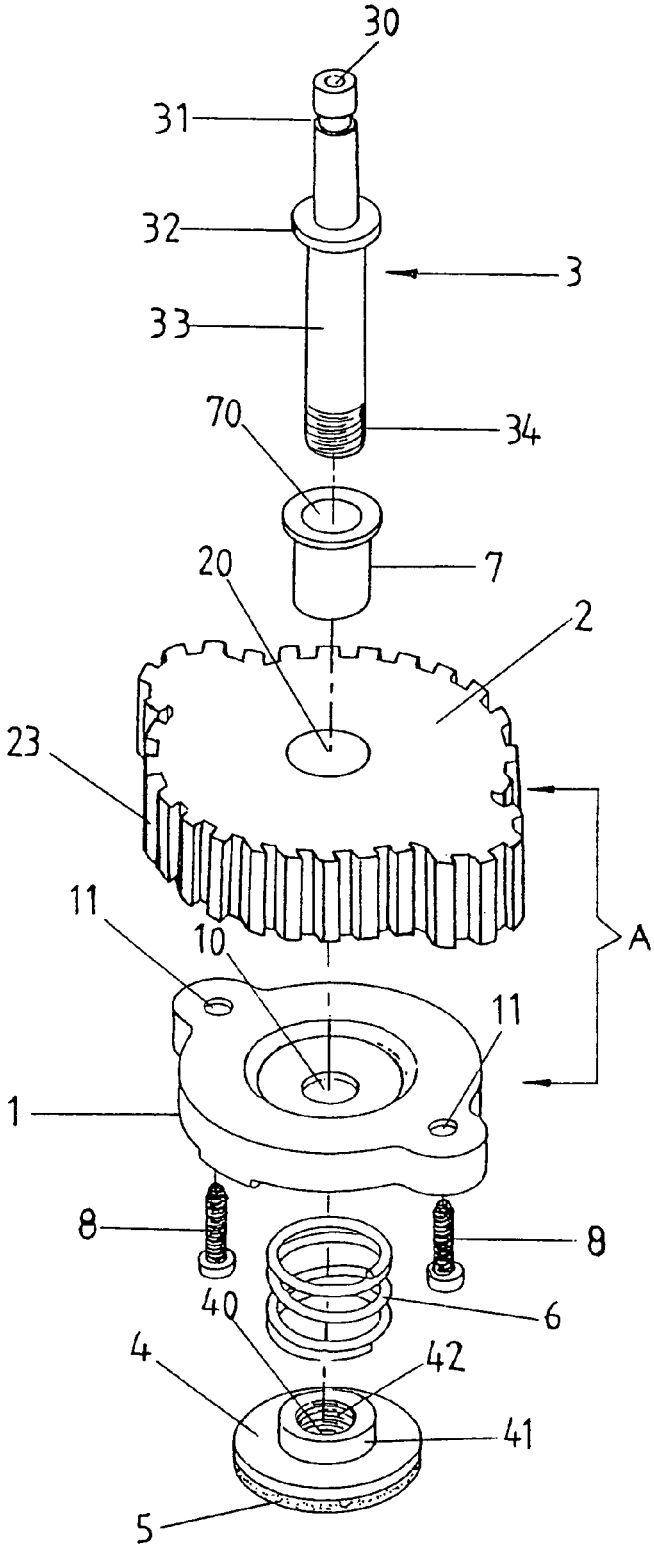
FIG. 4 is a perspective exploded view of the present invention.
Figure 5:
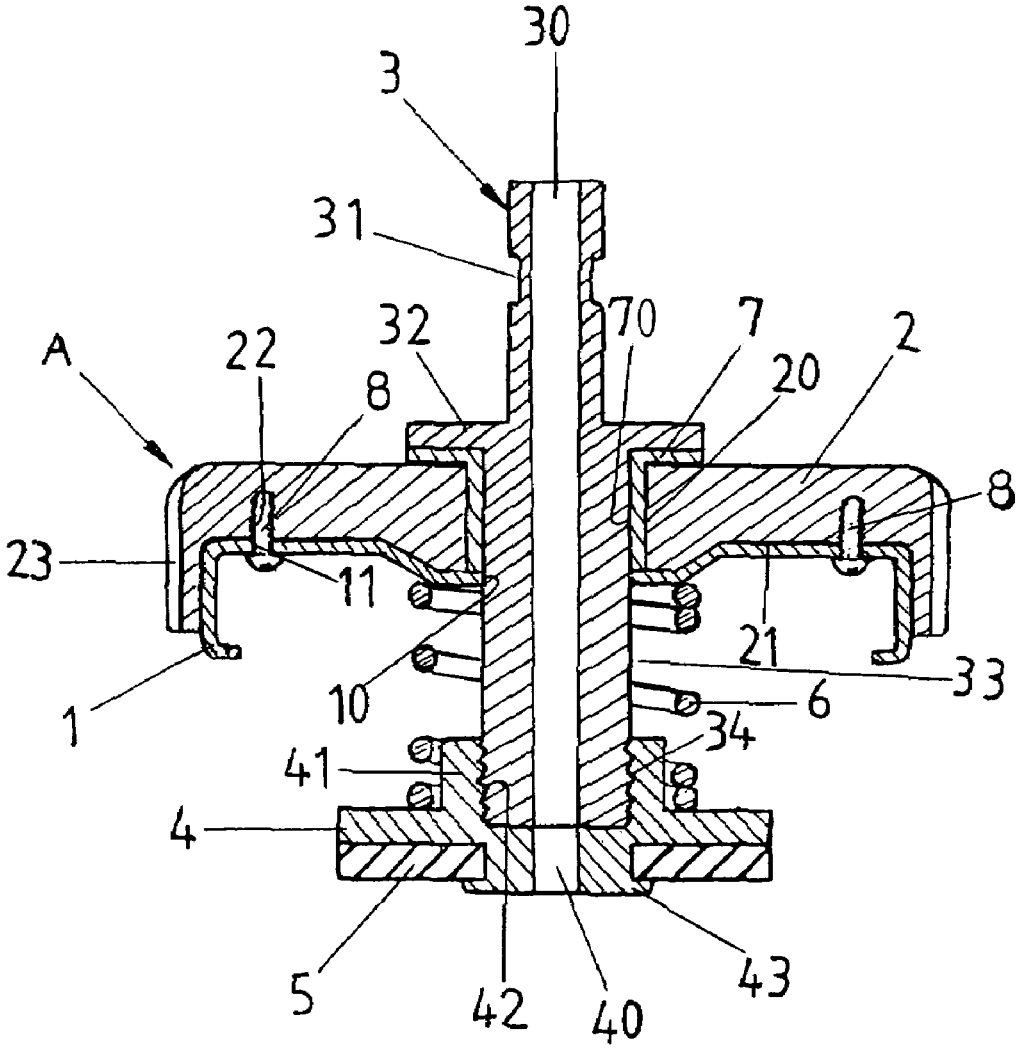
FIG. 5 is a sectional view of the present invention.

Referring to FIGS. 3, 4, and 5, there is shown a cap structure for a radiator used in vehicle, comprising a main cap body A (including a metallic cap body 1 and a non-metallic heat-isolation covering body 2), a connector shaft 3 and a leak-seal plate 4 and a leak-seal pad 5, a spring 6. The center of the metallic cap body 1 is a circular hole 10, and the surrounding of the circular hale 10 is provided with two symmetrical holes 11.

The heat-isolation covering body 2 has a bottom formed with a recess 21 and the top of the metallic cap body 1 is configured to fit into the recess 21. The bottom face of the recess 21 is provided with two screw holes 22 corresponding to the two holes 11 of the metallic cap body 1. The center circular hole 20 is mounted with a metallic sleeve 7. Further, the circumferential edge of the non-metallic heat-isolation covering body 2 is provided with slip-proof teeth 23.

The shaft center of the connector shaft 3 has a through hole 30 and the upper end of the shaft 3 has a quick connector 31. The intermediate portion 33 of the connector shaft 3 is provided with a flange 32 with an appropriate diameter. The connector shaft 3 has a threaded lower end 34.

The leak-seal plate 4 is a circular member. The upper side of the leak-seal plate 4 has a protruded seat 41, and the center of the leak-seal plate 4 has a screw hole 42. The center of the upper end of the protruded seat 41 has a through hole 40. The upper portion of the through hole 40 is larger than the lower portion of the through hole 40. The upper portion of the through hole 40 is threaded into a screw hole 42 to engage with the threaded lower end 34 of the connector shaft 3. The through hole 40 and the through hole 30 of the connector shaft are aligned with each other. Further, the leak-seal pad 5 is mounted at a recessed seat 43 at the bottom end of the leak-seal seat 4 to form as one unit.

In accordance with the present invention, the heat-isolation covering body 2 and the top end of the metallic cap body 1 are first mounted and screws 8 are passed through the two holes 11 to engage the recess 21 of the covering body 2 with the metallic cap body 1. The thickness of the heat-isolation covering body 2 and the thickness of the metallic cap body 1 are the same so as to increase the contact surface area of the threaded lower end 33 of the connector shaft 3. After that, the connector shaft 3 is passed through the circular hole of the metallic sleeve 7, the lower end shaft diameter 33 of the connector shaft 3 is exactly the same as the hole diameter of the circular hole 70 of the metallic sleeve 7, and the flange 32 of the connector shaft 3 urges the top face of the sleeve 7 of the heat-isolation covering body 2, and the connector shaft 3 is inserted with a spring 6. The center screw hole 42 is locked to the treaded lower end 34 at the bottom end of the connector shaft 3, and the spring 6 causes the connector shaft 3 and the leak-seal plate 5 and the leak-seal pad 6 to be urged at the main cap body A to move up and down axially.

Figure 6:
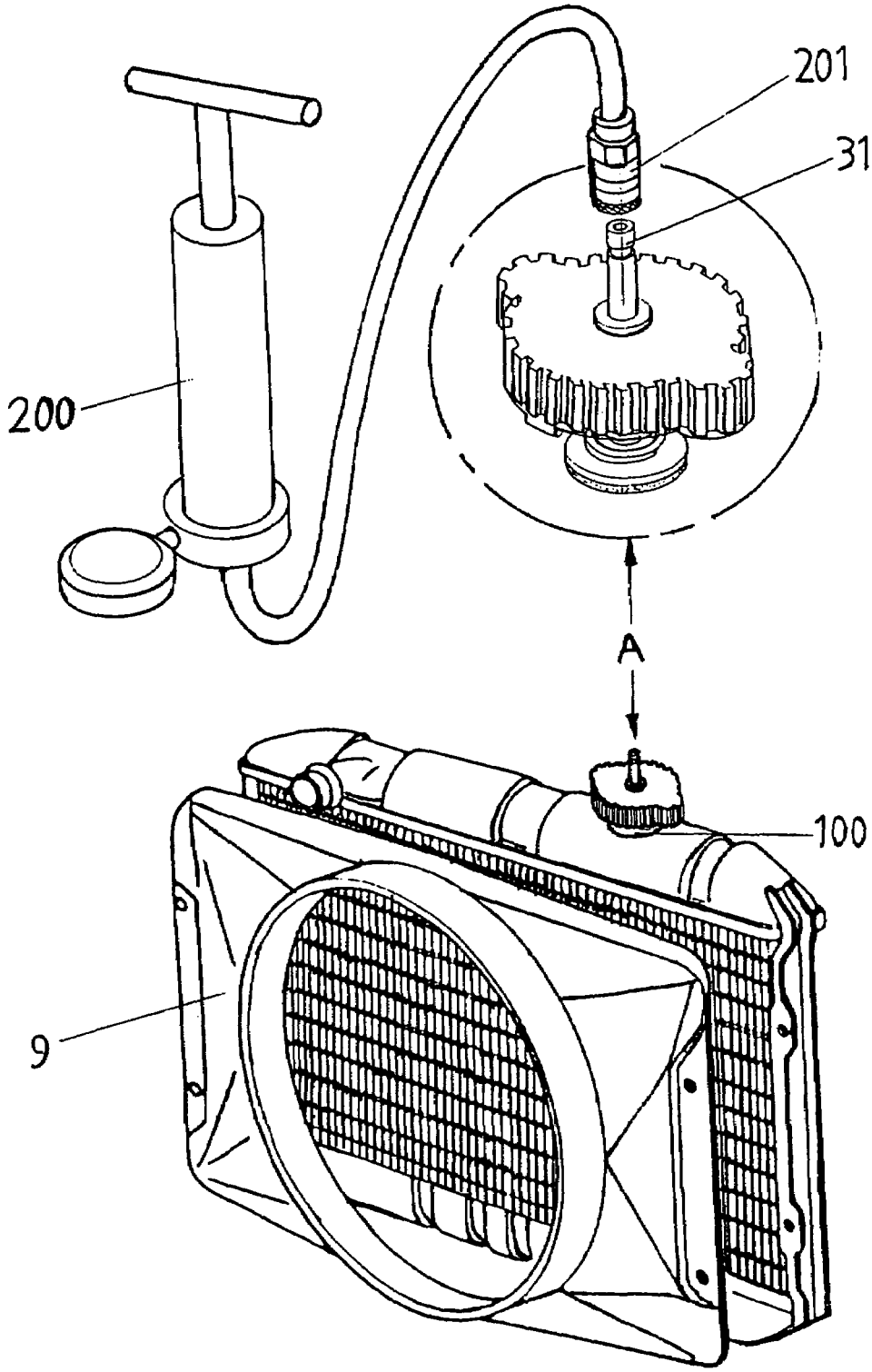
FIG. 6 is a schematic view showing the application of the cap structure of the present invention.

As shown in FIG. 6, the metallic cap body 1 is provided with a heat-isolation covering body 2 of large surface area allowing hand-gripping and the covering body 2 has slip-proof and heat-isolation properties. Thus, when the cap is held and rotated onto the mouth of the radiator, the gripping is strong which ensures tight seal to the mouth of the radiator.

In addition, the center circular hole 70 of the center sleeve 7 allows positioning of the shaft diameter of the connector shaft 3, and the leak-seal pad 6 is urged by the connector shaft 3 and will not move, the sealing of the cap to the mouth of the radiator is effective. Due to the thicker heat-isolation covering body 2 mounted onto the metallic cap body 1, it can cover one section of the quick connector 31 at the top end of the connector shaft 3 so that the end head exposed out of the connector shaft 3 becomes short. Thus, when the cap body is rotated, the top end of the quick connector 31 will not urge the palm of the user.

There are slip-proof teeth 23 provided at the lateral end of the covering body 2, and this will prevent slipping of the gripping of the palm.

Referring to FIG. 6, the main cap body A is mounted onto the mouth 100 of the radiator. To inspect whether there is leakage in water pressure, a pump 200 is connected to the quick connector seat 201 to pump air into the water tank of the radiator. Thus, leakage if any of the tank could be inspected.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cap structure for a radiator used in a vehicle comprising:

a main cap body including a metallic cap body and a non-metallic heat-isolation covering body, said metallic cap body having a center hole and two symmetrical holes at two opposite ends, said non-metallic heat-isolation covering body having a center hole, a bottom of said non-metallic heat-isolation covering body being formed with a recess, said recess being provided with two screw holes aligned with said holes of said metallic cap body, a top of said metallic cap body being configured to fit into said recess, said non-metallic heat-isolation covering body being provided with slip-proof teeth;

a sleeve fitted in said center hole of said non-metallic heat-isolation covering body;

two screws extending through said holes of said metallic cap body to engage with said screw holes of said non-metallic heat-isolation covering body;

a connector shaft having a center through hole and an intermediate portion provided with a flange, said connector shaft having a threaded lower end;

a circular leak-seal plate having a top provided with a protruded seat, said protruded seat having a center through hole, an upper portion of said center through hole being larger than a lower portion of said center through hole, said upper portion being threaded to engage with said threaded lower end of said connector shaft, a bottom portion of said circular leak-seal plate having a recessed seat;

a leak-seal pad engaged with said recessed seat; and a spring fitted between said circular leak-seal plate and said metallic cap body.

* * * * *